US011097137B2

(12) United States Patent
Fischer

(10) Patent No.: US 11,097,137 B2
(45) Date of Patent: Aug. 24, 2021

(54) DRYER APPLIANCE HAVING A FIRE EXTINGUISHING SYSTEM EQUIPPED WITH A NOZZLE AND BREAKAWAY CAP

(71) Applicant: Haier US Appliance Solutions, Inc., Wilmington, DE (US)

(72) Inventor: Austin Robert Fischer, Amelia, OH (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 161 days.

(21) Appl. No.: 16/654,687

(22) Filed: Oct. 16, 2019

(65) Prior Publication Data

US 2021/0113868 A1 Apr. 22, 2021

(51) Int. Cl.

| | |
|---|---|
| ***F26B 21/06*** | (2006.01) |
| ***A62C 3/00*** | (2006.01) |
| ***D06F 39/08*** | (2006.01) |
| ***D06F 37/42*** | (2006.01) |
| ***A62C 35/68*** | (2006.01) |
| ***D06F 58/30*** | (2020.01) |
| *D06F 58/50* | (2020.01) |

(52) U.S. Cl.

CPC ..... *A62C 3/00* (2013.01); *A62C 35/68* (2013.01); *D06F 37/42* (2013.01); *D06F 39/088* (2013.01); *D06F 58/30* (2020.02); *D06F 58/50* (2020.02); *D06F 2202/04* (2013.01); *D06F 2204/08* (2013.01)

(58) Field of Classification Search

CPC .. A62C 3/00; A62C 35/68; A62C 3/16; D06F 58/30; D06F 58/50; D06F 39/088; D06F 37/04; D06F 2204/08; D06F 2202/04; D06F 2105/00; D06F 2105/02; D06F 2103/00

USPC ..... 34/544, 108, 115; 239/11, 533.15, 239/533.13, 546

See application file for complete search history.

(56) References Cited

U.S. PATENT DOCUMENTS

| | | | | |
|---|---|---|---|---|
| 6,715,216 | B1 * | 4/2004 | Salameh | D06F 58/30 34/350 |
| 9,109,324 | B2 | 8/2015 | Chatot et al. | |
| 9,359,706 | B2 | 6/2016 | Lundbom | |
| 2013/0174441 | A1 * | 7/2013 | Grunert | D06F 58/20 34/524 |
| 2016/0115634 | A1 * | 4/2016 | Lundbom | D06F 39/088 68/19 |

FOREIGN PATENT DOCUMENTS

| | | | |
|---|---|---|---|
| KR | 101118620 | B1 | 3/2012 |
| WO | WO2009008631 | A1 | 1/2009 |

* cited by examiner

*Primary Examiner* — John P McCormack
(74) *Attorney, Agent, or Firm* — Dority & Manning, P.A.

(57) ABSTRACT

A dryer appliance that includes a fire extinguishing system is provided. In one aspect, the dryer appliance includes a drum rotatably mounted within a cabinet. The drum defines a chamber for receipt of articles for drying. The dryer appliance includes a water inlet valve in fluid communication with a nozzle to which a breakaway cap is mounted. The breakaway cap defines a steam outlet and the nozzle defines an extinguisher outlet. When a fire is present in the dryer appliance the water inlet valve is controlled to allow water to flow downstream to the nozzle so that the breakaway cap breaks away from the nozzle and water flows through the extinguisher outlet into the chamber of the drum to extinguish the fire.

19 Claims, 7 Drawing Sheets

DRYER APPLIANCE HAVING A FIRE EXTINGUISHING SYSTEM EQUIPPED WITH A NOZZLE AND BREAKAWAY CAP

FIELD OF THE INVENTION

The present subject matter relates generally to dryer appliances, and more particularly to dryer appliances having fire-extinguishing features.

BACKGROUND OF THE INVENTION

In rare instances, dryer appliances can catch on fire. For instance, clothes within a rotatably mounted drum of a dryer appliance can catch on fire during a drying cycle. Some conventional dryer appliances include a fire extinguishing or containment system to extinguish and/or contain detected fires within the drum. However, such conventional fire systems have proven to be unsatisfactory. For instance, some systems are only capable of containing the fire within the drum. Other systems are able to extinguish fires but add significant cost to the unit.

Accordingly, a dryer appliance and methods of operating the same that address one or more of the challenges noted above would be advantageous.

BRIEF DESCRIPTION OF THE INVENTION

Aspects and advantages of the invention will be set forth in part in the following description, or may be obvious from the description, or may be learned through practice of the invention.

In one aspect, a dryer appliance is provided. The dryer appliance includes a cabinet and a drum rotatably mounted within the cabinet. The drum defines a chamber for receipt of articles for drying. The dryer appliance also includes a nozzle defining an extinguisher outlet and a breakaway cap mounted to the nozzle. The breakaway cap defines a steam outlet. Wherein i) water flows through the extinguisher outlet and then downstream through the steam outlet of the breakaway cap and into the chamber of the drum when water provided to the nozzle does not apply a threshold force on the breakaway cap, and ii) the breakaway cap breaks away from the nozzle and water flows through the extinguisher outlet into the chamber of the drum when water provided to the nozzle applies the threshold force on the breakaway cap.

In another aspect, a dryer appliance is provided. The dryer appliance includes a cabinet and a drum rotatably mounted within the cabinet. The drum defines a chamber for receipt of articles for drying. Further, the dryer appliance includes a nozzle in fluid communication with the chamber of the drum. The nozzle defines an extinguisher outlet. The dryer appliance also includes a breakaway cap mounted to the nozzle and defining a steam outlet through which water is ejected into the chamber of the drum to form steam. The dryer appliance further includes a water inlet valve in fluid communication with a water supply and the nozzle. The dryer appliance also includes a fire detection device operable to detect fires. Moreover, the dryer appliance includes a controller communicatively coupled with the fire detection device and the water inlet valve. The controller is configured to: receive, from the fire detection device, an input indicating that a fire is present in the dryer appliance; and in response to the received input, cause the water inlet valve to allow water from the water supply to flow downstream to the nozzle so that the breakaway cap breaks away from the nozzle and water flows through the extinguisher outlet into the chamber of the drum.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
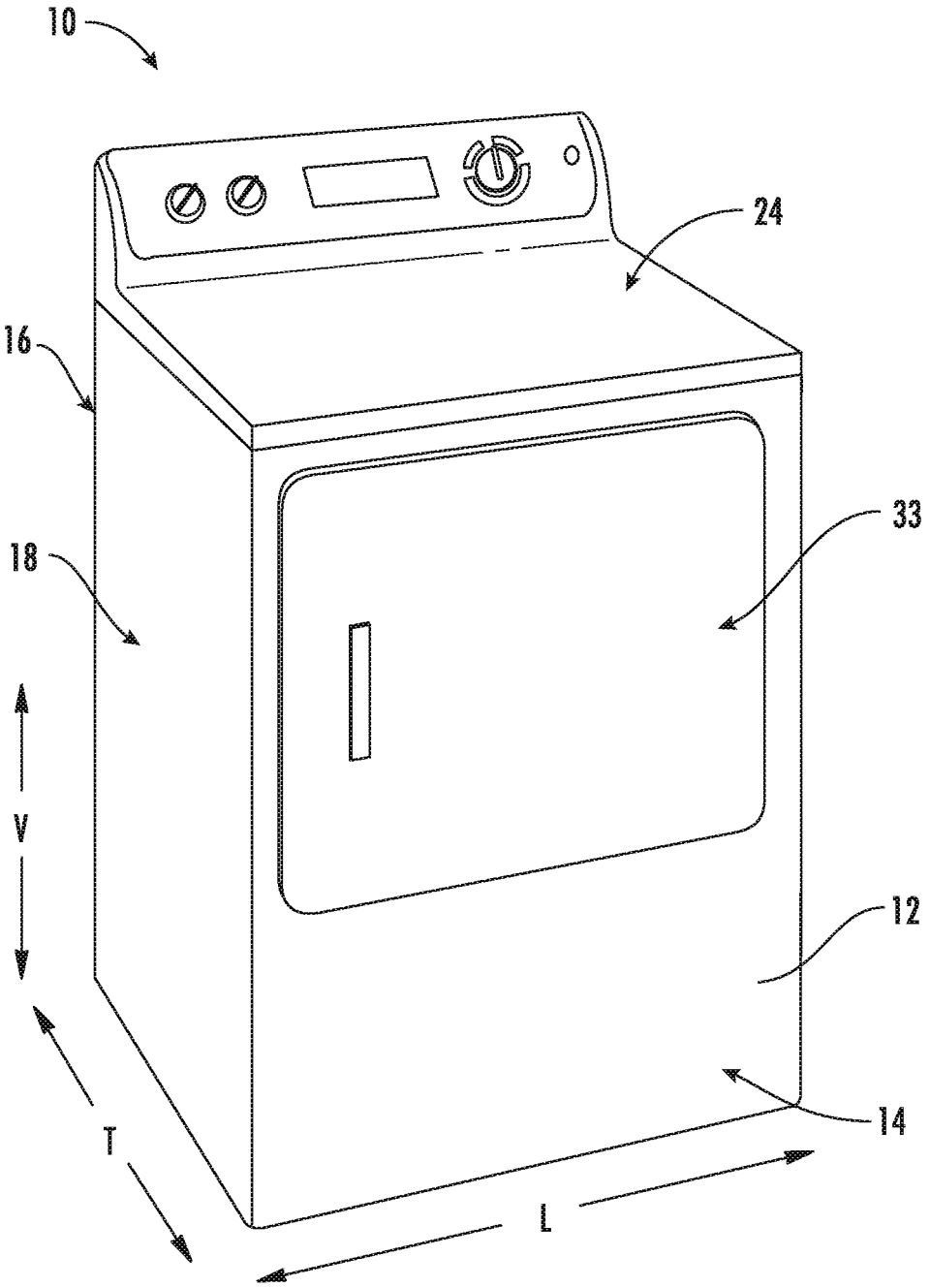
FIG. 1 provides a perspective view of a dryer appliance in accordance with exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
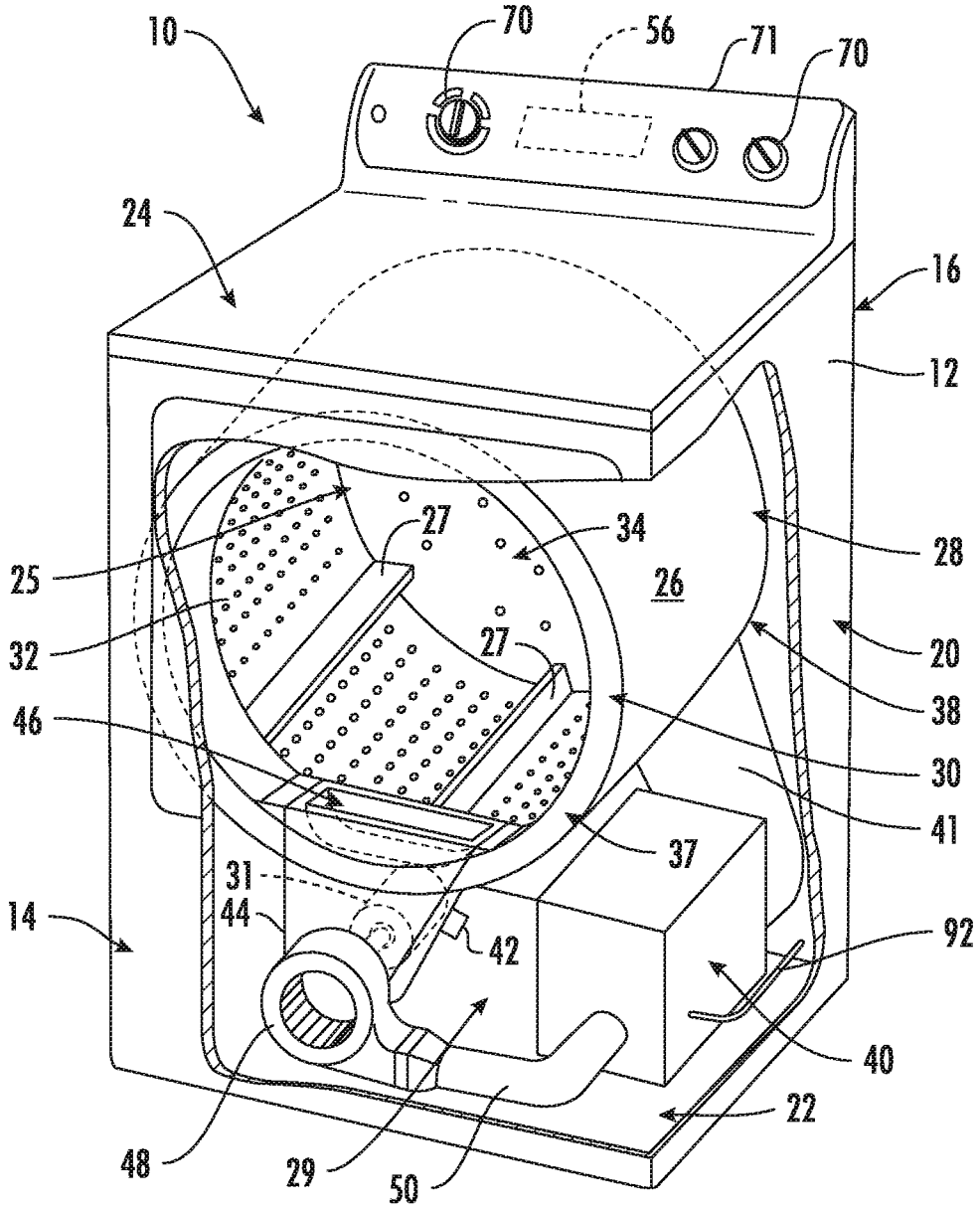
FIG. 2 provides a perspective view of the example dryer appliance of FIG. 1 with portions of a cabinet of the dryer appliance removed to reveal certain components of the dryer appliance.

FIGS. 1 and 2 provide perspective views of a dryer appliance 10 according to exemplary embodiments of the present disclosure. Particularly, FIG. 1 provides a perspective view of dryer appliance 10 and FIG. 2 provides another perspective view of dryer appliance 10 with a portion of a housing or cabinet 12 of dryer appliance 10 removed in order to show certain components of dryer appliance 10. As depicted, dryer appliance 10 defines a vertical direction V, a lateral direction L, and a transverse direction T, each of which is mutually perpendicular such that an orthogonal coordinate system is defined. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well. For instance, in some embodiments, dryer appliance 10 can be a combination washing machine/dryer appliance.

Cabinet 12 includes a front panel 14, a rear panel 16, a pair of side panels 18 and 20 spaced apart from each other by front and rear panels 14 and 16 along the lateral direction L, a bottom panel 22, and a top cover 24. Cabinet 12 defines an interior volume 29. A drum 26 is mounted for rotation about a substantially horizontal axis within the interior volume 29 of cabinet 12. Drum 26 defines a chamber 25 for receipt of articles for tumbling and/or drying. Drum 26 extends between a front portion 37 and a rear portion 38, e.g., along the transverse direction T. Dryer appliance 10 also includes a back or rear drum support 34 that forms a rear wall of drum 26 when assembled thereto. In this way, rear drum support 34 encloses chamber 25 of drum 26 at rear portion 38. For this embodiment, rear drum support 34 is stationary. A supply duct 41 may be mounted to rear drum support 34. Supply duct 41 receives heated air that has been heated by a conditioning system 40 and provides the heated air to drum 26 via one or more holes or openings defined by rear drum support 34.

As used herein, the terms "clothing" or "articles" includes but need not be limited to fabrics, textiles, garments, linens, papers, or other items from which the extraction of moisture is desirable. Furthermore, the term "load" or "laundry load" refers to the combination of clothing that may be washed together in a washing machine or dried together in a dryer appliance 10 (e.g., clothes dryer) and may include a mixture of different or similar articles of clothing of different or similar types and kinds of fabrics, textiles, garments and linens within a particular laundering process.

In some embodiments, a motor 31 is provided to rotate drum 26 about the horizontal axis, e.g., via a pulley and a belt (not pictured). Drum 26 is generally cylindrical in shape. Drum 26 has an outer cylindrical wall 28 and a front flange 30 that defines an opening 32 of drum 26, e.g., at front portion 37 of drum 26, for loading and unloading of articles into and out of chamber 25 of drum 26. Front flange 30 can be lined with felt to allow drum 26 to rotate more efficiently by reducing friction between drum 26 and a front drum support. Drum 26 also includes a rear flange 39, e.g., at rear portion 38 of drum 26. Like front flange 30, rear flange 39 can be lined with felt to allow drum 26 to rotate more efficiently by reducing friction between drum 26 and rear drum support 34. Furthermore, drum 26 includes a plurality of lifters or baffles 27 that extend into chamber 25 to lift articles therein and then allow such articles to tumble back to a bottom of drum 26 as drum 26 rotates. Baffles 27 may be mounted to drum 26 such that baffles 27 rotate with drum 26 during operation of dryer appliance 10.

Rear drum support 34 can include a plurality of holes or openings that receive hot air that has been heated by a conditioning system 40. Moisture laden, heated air is drawn from drum 26 by an air handler, such as a blower fan 48, which generates a negative air pressure within drum 26. The moisture laden heated air passes through a duct 44 enclosing screen filter 46, which traps lint particles. As the air passes from blower fan 48, it enters a duct 50 and then is passed into conditioning system 40. In some embodiments, the conditioning system 40 can be or include an electric heating element, e.g., a resistive heating element, or a gas-powered heating element, e.g., a gas burner. For this embodiment, dryer appliance 10 is a heat pump dryer appliance and thus conditioning system 40 can be or include a heat pump including a sealed refrigerant circuit. Heated air (with a lower moisture content than was received from drum 26), exits conditioning system 40 and returns to drum 26 by duct 41. After the clothing articles have been dried, they are removed from the drum 26 via opening 32. A door 33 provides for closing or accessing drum 26 through opening 32.

In some embodiments, one or more selector inputs 70, such as knobs, buttons, touchscreen interfaces, etc., may be provided or mounted on a cabinet 12 (e.g., on a backsplash 71) and are communicatively coupled with (e.g., electrically coupled or coupled through a wireless network band) a processing device or controller 56. Controller 56 may also be communicatively coupled with various operational components of dryer appliance 10, such as motor 31, blower 48, components of conditioning system 40, and other components of dryer appliance 10. In turn, signals generated in controller 56 direct operation of motor 31, blower 48, conditioning system 40, and/or other components of dryer appliance 10 in response user inputs to selector inputs 70. As used herein, "processing device" or "controller" may refer to one or more microprocessors, microcontroller, ASICS, or semiconductor devices and is not restricted necessarily to a single element. The controller 56 may be programmed to operate dryer appliance 10 by executing instructions stored in memory (e.g., non-transitory media). The controller 56 may include, or be associated with, one or more memory elements such as RAM, ROM, or electrically erasable, programmable read only memory (EEPROM). For example, the instructions may be software or any set of instructions that when executed by the processing device, cause the processing device to perform operations. It should be noted that controller 56 as disclosed herein is capable of and may be operable to perform any methods or associated method steps as disclosed herein. For example, in some embodiments, methods disclosed herein may be embodied in programming instructions stored in the memory and executed by the controller 56. As will be explained further below, controller 56 can control various components of dryer appliance 10 in the event a fire is detected in chamber 25 of drum 26.

Figure 3:
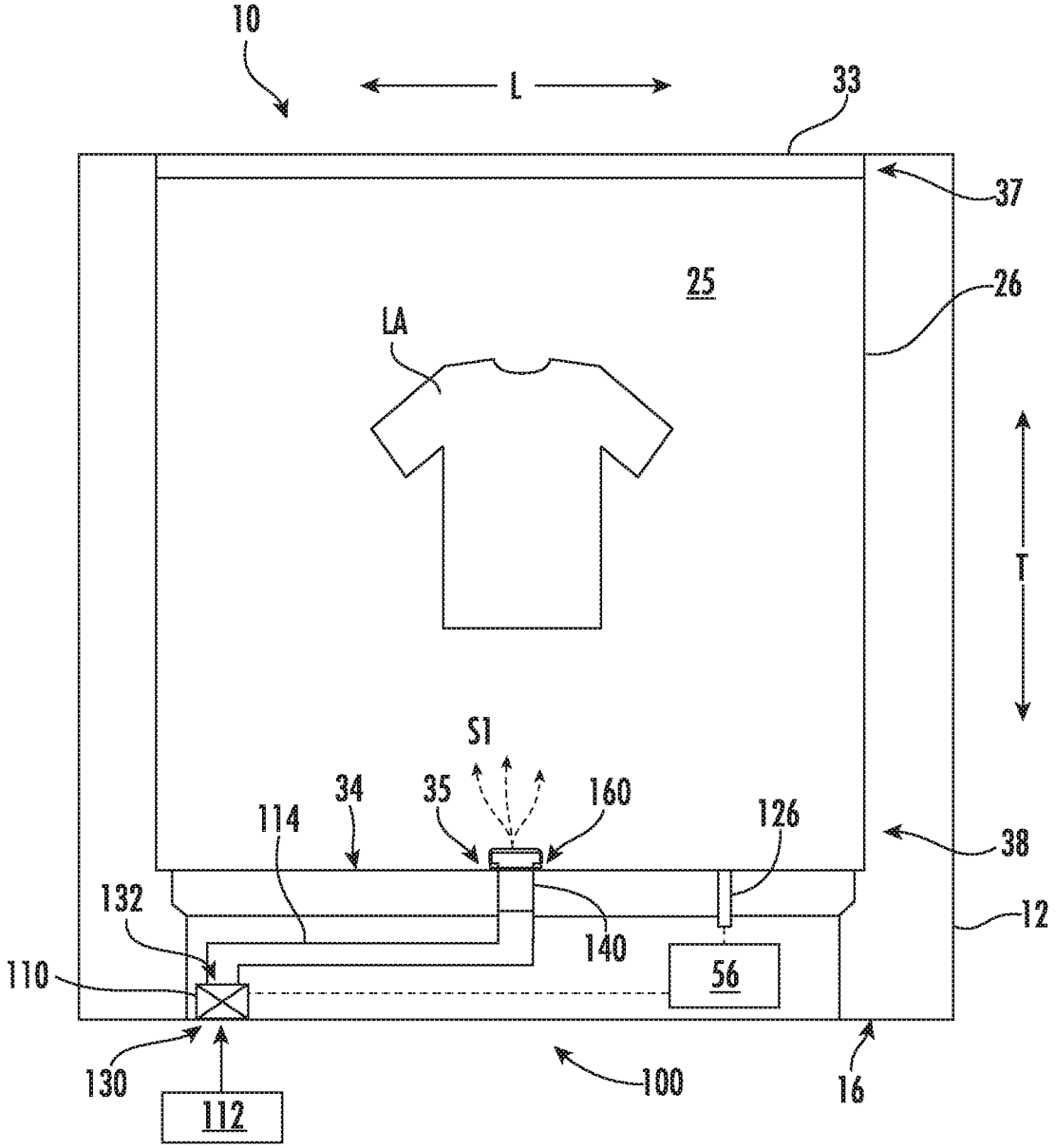
FIG. 3 provides a schematic top view of the dryer appliance and depicts a fire extinguishing system thereof.

FIG. 3 provides a schematic top view of dryer appliance 10 and depicts a fire extinguishing system 100 thereof. Generally, fire extinguishing system 100 is operable to extinguish a detected fire. More particularly, fire extinguishing system 100 includes features for automatically detecting and extinguishing a fire in or around chamber 25 of drum 26. Various components of fire extinguishing system 100 will be described below.

As depicted, dryer appliance 10, and more particularly fire extinguishing system 100, includes a water inlet valve 110. For this embodiment, water inlet valve 110 is mounted to rear panel 16 of cabinet 12. Water inlet valve 110 is in fluid communication with a water supply 112. In this manner, water can flow from water supply 112 downstream to water inlet valve 110. Water supply 112 can be any suitable source or supply of water. As one example, water supply 112 can be a water line of a consumer's home. Thus, in some embodiments, water supply 112 is a continuous water supply. Meaning, water supply 112 need not be refilled manually and water is readily available.

Water inlet valve 110 can be any suitable type of valve. As one example, water inlet valve 110 can be a solenoid valve. In such example embodiments, water inlet valve 110 is movable to a closed position and an open position. In the closed position, water inlet valve 110 prevents water from flowing therethrough. In the open position, water inlet valve 110 allows water to flow from water supply 112 through water inlet valve 110 and ultimately downstream thereof, e.g., to a nozzle as will be described further below. As another example, water inlet valve 110 can be a control valve operable to control the flow rate of water therethrough, e.g., based on one or more control commands from controller 56. In such example embodiments, water inlet valve 110 is movable to a closed position and an open position, wherein in the open position, the valve position of water inlet valve 110 can be controlled such that the water flow rate therethrough can be controlled. As depicted in FIG. 3, water inlet valve 110 is communicatively coupled with controller 56, e.g., via a suitable wired and/or wireless communication link.

Water inlet valve 110 has at least one inlet and at least one outlet. For this embodiment, water inlet valve 110 has an inlet 130 and an outlet 132. Water from water supply 112 can flow downstream and enter water inlet valve 110 through inlet 130. A delivery conduit 114 (e.g., a hose) fluidly connects outlet 132 of water inlet valve 110 with an inlet of a nozzle 140 positioned downstream thereof. In FIG. 3, nozzle 140 has a breakaway cap 120 mounted thereto. Nozzle 140 extends through one of the one or more openings 35 defined by rear drum support 34. Thus, a forward portion of nozzle 140 is positioned within chamber 25 of drum 26 and a rear or back portion of nozzle 140 is not positioned within chamber 25. Nozzle 140 is mounted to and supported by rear drum support 34.

Figure 4:
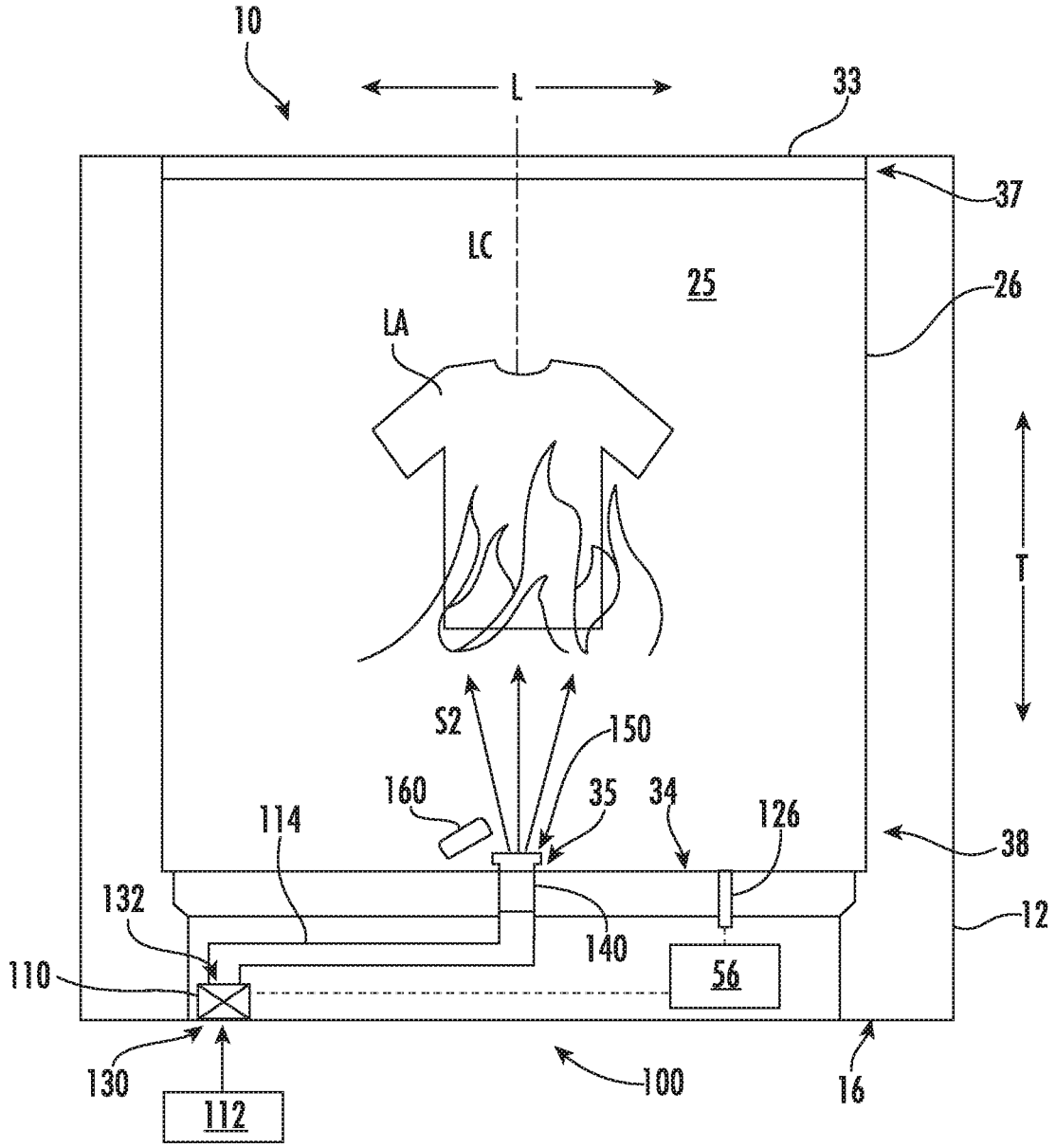
FIG. 4 provides another schematic top view of the dryer appliance and depicts the fire extinguishing system performing an extinguishing operation.

Nozzle 140 is in fluid communication with water inlet valve 110 and with chamber 25 of drum 26. In this manner, when water inlet valve 110 is moved to an open position, water can flow from water supply 112 through water inlet valve 110 and downstream to nozzle 140. As will be explained herein, water can be ejected into chamber 25 of drum 26 through an outlet of breakaway cap 160 when breakaway cap 160 is mounted to nozzle 140, e.g., as shown in FIG. 3, or in instances where a fire is detected in chamber 25 of drum 26, water delivered to nozzle 140 can cause breakaway cap 116 to break away from nozzle 140 and water can be ejected into chamber 25 of drum 26 via an outlet of nozzle 140 to extinguish the detected fire, e.g., as shown in FIG. 4.

Figure 6:
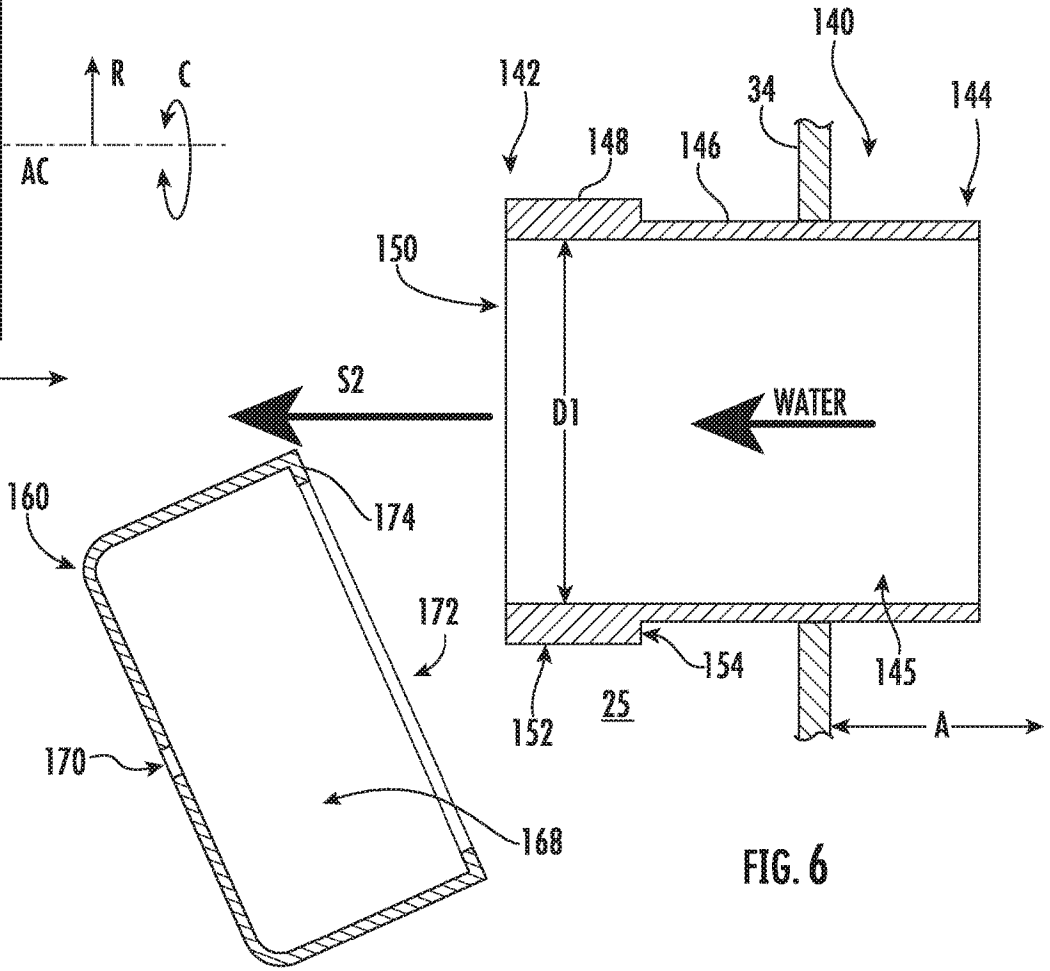
FIG. 6 provides a close up, schematic cross-sectional side view of the breakaway cap broken away from the nozzle.
Figure 5:
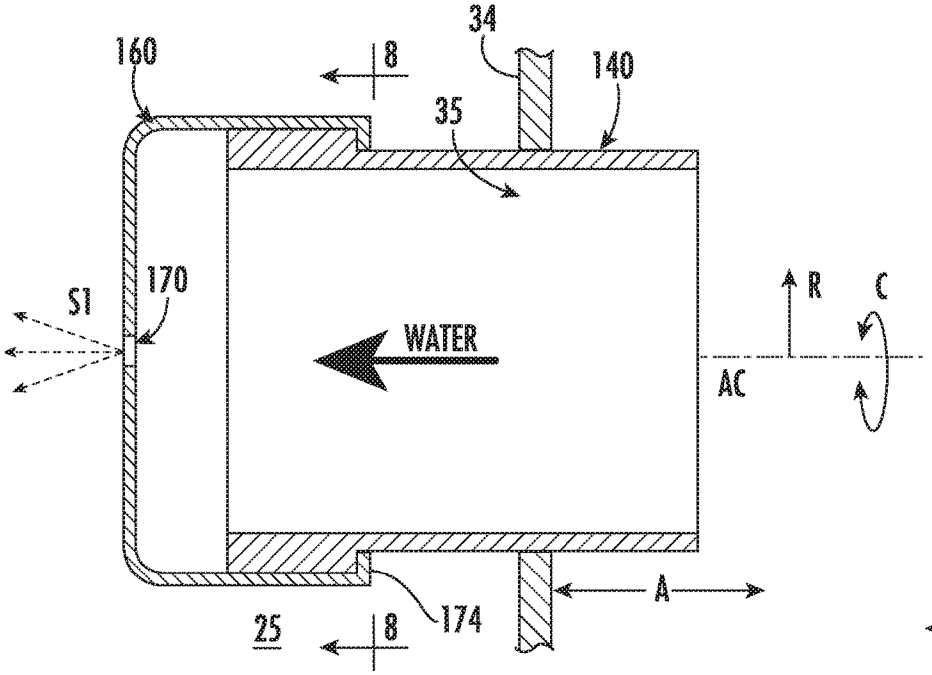
FIG. 5 provides a close up, schematic cross-sectional side view of a nozzle of the fire extinguishing system of FIGS. 3 and 4 with a breakaway cap mounted thereto.

With reference now to FIGS. 5 and 6, FIG. 5 provides a close up, schematic cross-sectional side view of nozzle 140 with breakaway cap 120 mounted thereto and FIG. 6 provides a close up, schematic cross-sectional side view of breakaway cap 120 broken away from nozzle 140. Nozzle 140 defines an axial direction A, a radial direction R, and a circumferential direction C. In addition, nozzle 140 defines an axial centerline AC that extends along the axial direction A. Nozzle extends between a first end 142 and a second end 144 along the axial direction A (which corresponds with the transverse direction T (FIG. 3) in this embodiment). Moreover, for this embodiment, first end 142 is the forward end or front of nozzle 140 and second end 144 is the back or rear of nozzle 140. Nozzle 140 has a body 146 that defines a flow passage 145 through which water may flow. At first end 142, nozzle 140 defines an extinguisher outlet 150. Extinguisher outlet 150 has a first diameter D1. Although nozzle 140 is shown having a relatively straight or linear flow passage, in some embodiments, nozzle 140 can define a Venturi-style flow passage 145 having a constricting throat and diverging outlet (e.g., to accelerate the water ejected therefrom).

Furthermore, nozzle 140 includes a flange 148 at or adjacent first end 142. For this embodiment, flange 148 is an annular flange that extends outward from body 146 of nozzle 140 along the radial direction R and circumferentially around body 146. Flange 148 has a first surface 152 and a second surface 154. First surface 152 is the radially outer surface of flange 148 and second surface 154 extends annularly in a plane orthogonal to the axial direction A.

Figure 7:
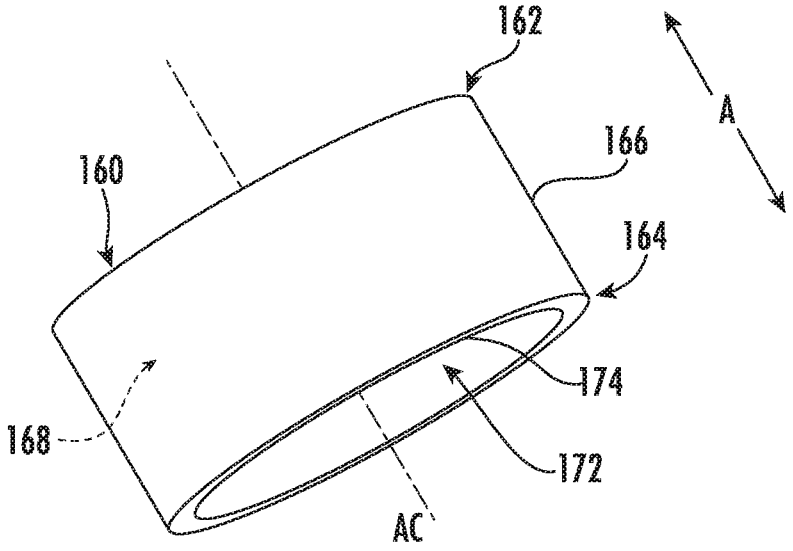
FIG. 7 provides a perspective view of the breakaway cap.
Figure 8:
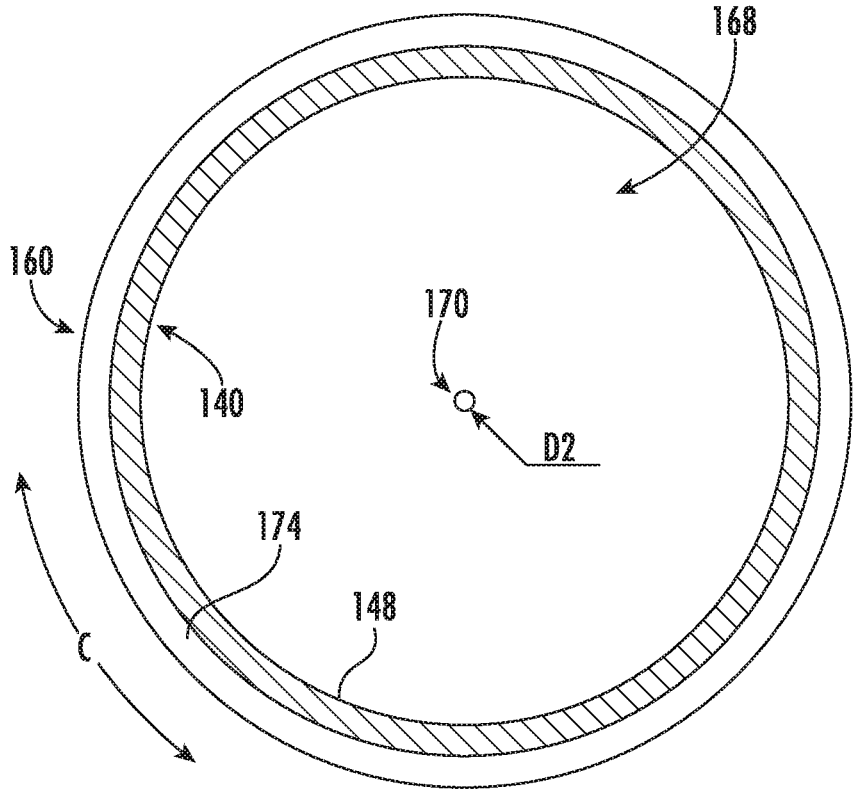
FIG. 8 provides a rear cross-sectional view taken along line 8-8 of FIG. 5 that depicts the breakaway cap mounted to the nozzle.

With reference now to FIGS. 5, 6, 7, and 8, FIG. 7 provides a perspective view of breakaway cap 160 and FIG. 8 provides a rear cross-sectional view taken along line 8-8 of FIG. 5 that depicts breakaway cap 160 mounted to nozzle 140. Breakaway cap 160 extends between a first end 162 and a second end 164 along the axial direction A as shown best in FIG. 7. For this embodiment, first end 162 is the forward end or front of breakaway cap 160 and second end 144 is the back or rear of breakaway cap 160. Breakaway cap 160 has a body 166 that is generally cylindrical. Body 166 defines an interior volume 168 (FIGS. 6 and 7) that is generally sized to receive at least a portion of nozzle 140 as shown best FIG. 5. Body 166 of breakaway cap 160 defines an opening 172 at second end 164 that provides access to or communication with interior volume 168. Opening 172 is sized so that breakaway cap 160 can be fit over first end 142 of nozzle 140 yet still engage first surface 152 of annular flange 148 of nozzle 140. In some embodiments, the breakaway cap 160 engages first surface 152 to form an annular seal that prevents water from leaking or flowing therebetween.

Breakaway cap 160 has a securing mechanism 174 that facilitates securing of breakaway cap 160 to nozzle 140 during normal operation. Particularly, when breakaway cap 160 is mounted to nozzle 140, securing mechanism 174 of breakaway cap 160 engages flange 148 of nozzle 140 to secure breakaway cap 160 to nozzle 140. For this embodiment, as best shown in FIG. 7, securing mechanism 174 is a securing flange that extends radially inward from body 166 and thus defines the diameter of opening 172. As shown best in FIGS. 5 and 8, when breakaway cap 160 is mounted to nozzle 140, the annular securing flange engages second surface 154 of annular flange 148 of nozzle 140.

In some embodiments, the securing flange of breakaway cap 160 can be formed of a semi-rigid or elastic material. In this manner, when water delivered to nozzle 140 applies a threshold force on breakaway cap 160, the threshold force can overcome the "grip" that the securing flange has on the flange 148 causing the breakaway cap 160 to break away from nozzle 140. The semi-rigid or elastic securing flange can lessen the force required to break the breakaway cap 160 from nozzle 140.

Breakaway cap 160 defines a steam outlet 170. As shown best in FIG. 8, steam outlet 170 has a second diameter D2. The first diameter D1 of extinguisher outlet 150 is greater than the second diameter D2 of steam outlet 170. In some embodiments, such as the depicted embodiment, first diameter D1 of extinguisher outlet 150 is at least ten times greater than second diameter D2 of steam outlet 170. In some embodiments, for example, the second diameter D2 of the steam outlet 170 can be 0.5 mm and the first diameter D1 of the extinguisher outlet 150 can be at least 5 mm.

Notably, in some instances, breakaway cap 160 functions as a steam nozzle. Specifically, when water is provided to nozzle 140 and the provided water does not apply a threshold force on breakaway cap 160, the water flows through extinguisher outlet 150 of nozzle 140 and then downstream through steam outlet 170 of breakaway cap 160 and into chamber 25 of drum 26. The diameter of the steam outlet 170 is sized so that the water directed into chamber 25 mixes with the relatively hot air to become mist or steam. In this manner, during a drying cycle and/or thereafter, the laundry articles LA within chamber 25 can be steamed. Thus, the laundry articles LA within chamber 25 may be less prone to wrinkling, among other benefits. The water can be ejected from steam outlet 170 of breakaway cap 160 in a mist-like spray as shown in FIG. 3 by the arrows labeled as "S1".

To commence a steam operation, controller 56 is configured to receive an input indicative of instructions for commencing a steam operation. For instance, a user can commence a steam operation by providing a user input to one of the selector inputs 70 (FIG. 2). Additionally or alternatively, controller 56 can commence automatically commence a steam operation based at least in part on the selected drying cycle settings. In response to the received input indicative of instructions for commencing a steam operation, controller 56 is configured to cause water inlet valve 110 to allow water to flow from water supply 112 to nozzle 140 such that water provided to nozzle 140 does not apply the threshold force on breakaway cap 160 and so that water flows through extinguisher outlet 150 of nozzle 140 and then downstream through steam outlet 170 of breakaway cap 160 and into chamber 25 of drum 26. In this way, the water mixes with air within chamber 25 to form steam.

Upon detection of a fire in drum 26, a volume of water can be delivered to nozzle 140 such that the water applies a threshold force on the breakaway cap 160, causing breakaway cap 160 to break away from nozzle 140, e.g., as shown in FIGS. 4 and 6. With breakaway cap 160 removed from nozzle 140, water is ejected from extinguisher outlet 150 of nozzle 140 directly into chamber 25 of drum 26. In some embodiments, when the water reaches nozzle 140, the pressure of the water is increased by nozzle 140 and consequently the water is ejected in a stream (e.g., a jet-like stream) from nozzle 140 into chamber 25 of drum 26 as shown by the arrows labeled as "S2" in FIG. 4. The stream S2 ejected from nozzle 140 is sufficient in volume to readily extinguish drum fires. Particularly, the first diameter D1 of the extinguisher outlet 150 of nozzle 140 is sized so that a stream of water ejected therefrom exits nozzle 140 having a volume sufficient to readily extinguish a fire within chamber 25.

For this embodiment, as shown in FIG. 4, nozzle 140 is positioned or oriented along a lateral centerline LC that extends midway between the left and right side of drum 26 along the lateral direction L. In this way, nozzle 140 is centrally positioned to extinguish a detected fire. In other embodiments, nozzle 140 can be located in other positions.

Dryer appliance 10 also includes a fire detection device 126. Fire detection device 126 is operable to detect dryer fires, and more particularly, fires within chamber 25 of drum 26, e.g., as shown in FIG. 4. Fire detection device 126 can be any suitable type of device capable of detecting a fire. For instance, in some embodiments, fire detection device 126 can be a temperature sensor. In other embodiments, fire detection device 126 can be a smoke sensor. In yet other embodiments, fire detection device 126 can be a camera (e.g., a fire resistant camera). Fire detection device 126 is communicatively coupled with controller 56, e.g., via a suitable wired and/or wireless communication link. In this manner, controller 56 can receive one or more inputs from fire detection device 126. For instance, controller 56 can receive an input from fire detection device 126 indicating that a fire is present in chamber 25 of drum 26.

In yet other embodiments, fire detection device 126 can be a thermostat having a fire sensing device and an onboard controller. The onboard controller can have or include any of the components described above with respect to controller 56, e.g., one or more processors and one or more memory devices, such as non-transitory readable media. In such embodiments, the thermostat can be communicatively coupled with water inlet valve 110 as well as other components of dryer appliance 10, such as controller 56.

As further shown in FIG. 4, various components of fire extinguisher system 100 are supported by rear drum support 34. Rear drum support 34 generally supports drum 26 at rear portion 38 of drum 26 and also encloses chamber 25 at rear portion 38. One of the openings 35 defined by rear drum support 34 can support and hold nozzle 140. Moreover, for this embodiment, nozzle 140 is located at the rear of dryer appliance 10, e.g., at rear portion 38 of drum 26. In this manner, less pluming to nozzle 140 is required, e.g., compared to systems having a nozzle at a middle or forward portion of drum 26. Thus, the positioning of the nozzle 140 as depicted in FIG. 4 may provide a cost benefit.

An example manner in which fire extinguisher system 100 of dryer appliance 10 can extinguish a detected fire will now be described. During operation of dryer appliance 10 in a drying cycle or at any time in which dryer appliance 10 is supplied electrical power (even in a standby mode), dryer appliance 10 can monitor for fires. Particularly, fire detection device 126 can monitor for fires. Fire detection device 126 can monitor for fires continuously or at a predetermined interval, e.g., every five (5) seconds. Fire detection device 126 can monitor for fires and can send and controller 56 can receive one or more electrical signals indicating whether a fire is present in dryer appliance 10. Specifically, when fire detection device 126 senses that a fire is present in drum 26, controller 56 can receive an input from fire detection device 126 indicating that a fire has been detected, e.g., in chamber 25 of drum 26.

In some embodiments, for example, fire detection device 126 can be a temperature sensing device having a set point temperature corresponding to an ignition temperature at which a predetermined fabric type is likely to catch fire. The predetermined fabric can be cotton, polyester, etc., for example. When the temperature sensing device senses a temperature within drum 26 that exceeds the set point temperature, controller 56 can receive an input from the temperature sensing device indicating that a fire is present within drum 26.

Upon receiving an input indicating that a fire is present within dryer appliance 10, e.g., within chamber 25 of drum 26, controller 56 is configured to take action to extinguish the fire. More particularly, in response to receiving an input indicating that a fire is present within dryer appliance 10, controller 56 is configured to cause water inlet valve 110 to move to an open position. For instance, controller 56 can send and water inlet valve 110 can receive one or more control commands that cause water inlet valve 110 to move to the open position. In this way, water flows from water supply 112 downstream into dryer appliance 10 and ultimately to nozzle 140. As noted, water supply 112 can be a readily available, continuous water supply and thus water can be supplied to extinguish the fire at any moment.

As shown best in FIG. 4, when controller 56 causes water inlet valve 110 to move to the open position in response to the one or more signals indicating that a fire has been detected, water flows from water supply 112 downstream into dryer appliance 10 and through open water inlet valve 110. The water continues downstream along delivery conduit 114 to nozzle 140. When the water provided to nozzle 140 applies a threshold force on breakaway cap 160, breakaway cap 160 breaks away from nozzle 140 as shown in FIG. 4. Consequently, water flows through extinguisher outlet 150 of nozzle 140 and into chamber 25 of drum 26. As noted, water can be ejected from extinguisher nozzle 150 in a stream (e.g., a jet-like stream) as shown by the arrows labeled as "S2" in FIG. 4. The stream S2 ejected from nozzle 140 is sufficient in volume to readily extinguish drum fires.

In some embodiments, to build up the velocity at which the water provided to the nozzle 140 impacts the breakaway cap 160, prior to causing water inlet valve 110 to allow water to flow from water supply 112 to nozzle 114 in response to the received input, controller 56 is further configured to cause water inlet valve 110 to hold a volume of water upstream thereof for a predetermined time to increase a water pressure of the water. In this way, when controller 56 causes water inlet valve 110 to allow water to flow from water supply 112 to nozzle 140, a burst of water is provided to nozzle 140 to apply the threshold force on the breakaway cap 160. Stated another way, when a fire is detected in drum 26, water inlet valve 110 (or alternatively another mechanical device) builds up or increases the pressure of the water so that when the water is released downstream to nozzle 140, the volume of water having increased pressure applies a quick burst of force to breakaway cap 160, which causes breakaway cap 160 to break away from nozzle 140. That is, the force that the water applies to or on the breakaway cap 160 is sufficient to overcome the engagement of securing mechanism 174 of breakaway cap 160 to flange 148 of nozzle 140. When the provided water applies the threshold force on breakaway cap 160, breakaway cap 160 shoots off nozzle 140 thus releasing liquid water into drum 26.

Figure 9:
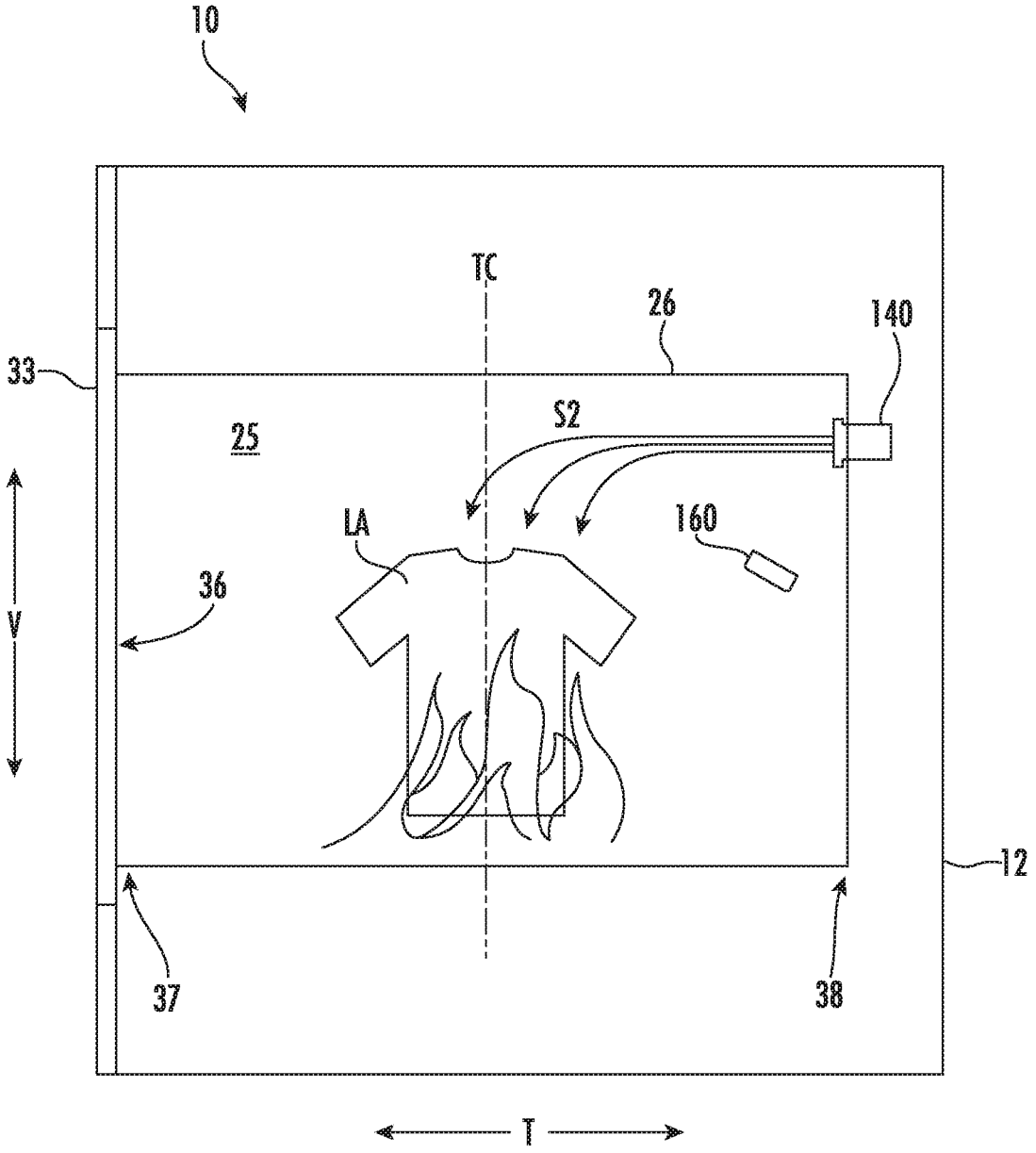
FIG. 9 provides a side schematic view of the dryer appliance and depicts the fire extinguishing system performing the extinguishing operation.

FIG. 9 provides a side schematic view of dryer appliance 10. Particularly, FIG. 9 depicts nozzle 140 directing a stream of water S2 into chamber 25 to extinguish the detected fire. As depicted, drum 26 defines a transverse centerline TC or plane positioned midway between front portion 37 and rear portion 38 of drum 26 along the transverse direction T. As depicted, at least a portion of the water stream S2 ejected from nozzle 140 into chamber 25 reaches at least the transverse centerline TC of drum 26. In this manner, the ejected water is more likely to extinguish the detected fire. In yet embodiments, at least a portion of the water stream S2 ejected from nozzle 140 into chamber 25 reaches at least an interior side 36 of door 33. In this way, at least a portion of the ejected water travels the entire transverse length of drum 26, and consequently, is more likely to extinguish the detected fire. Controller 56 can control the mass flow rate of the water into fire extinguishing system 100 to generate such streams, e.g., by controlling the valve position of water inlet valve 110. Additionally or alternatively, nozzle 140 can be configured to generate such streams.

Returning to FIG. 4, in some embodiments, in response to receiving an input indicating that a fire is present within dryer appliance 10, controller 56 is configured to cause drum 26 to cease rotating about its axis of rotation. Moreover, controller 56 can also cease operation of conditioning system 40 (FIG. 2) as well as blower fan 48 (FIG. 2), among other possible components. In this manner, the detected fire ceases being a moving target and airflow to fire is decreased. Moreover, by ceasing operation of conditioning system 40, heated air will cease being introduced into chamber 25 of drum 26.

In some embodiments, as noted, water inlet valve 110 is a control valve that can be controlled such that the flow rate of the water through water inlet valve 110 can be controlled, e.g., based at least in part on one or more control commands received from controller 56. In such embodiments, after breakaway cap 160 has broken away from nozzle 140, water inlet valve 110 can be moved to one of a plurality of open positions. For instance, two open valve positions can include a halfway open position and a fully open position, among other possible open positions. Controller 56 can cause water inlet valve 110 to adjust the flow rate of water therethrough, e.g., by adjusting the valve position of water inlet valve 110. By way of example, in response to receiving an input indicating that a fire is present within dryer appliance 10, e.g., within chamber 25 of drum 26, after breakaway cap 160 has broken away from nozzle 140, controller 56 can be configured to cause water inlet valve 110 to move to a halfway open position, i.e., a position that is halfway between a fully open position and a closed position. If the fire has not been extinguished after a predetermined time (as determined by signals received from fire detection device 126), controller 56 can cause water inlet valve 110 to adjust the flow rate of the water flowing therethrough by causing water inlet valve 110 to move its valve position to a fully open position, e.g., to increase the flow rate of the water passing through water inlet valve 110 and ultimately increase the extinguishing ability of fire extinguishing system 100. By initially positioning the valve position of the water inlet valve 110 at the halfway open position, cleanup of the ejected water may be less extensive.

As fire extinguishing system 100 is actively extinguishing a detected fire, controller 56 can continue to receive inputs from fire detection device 126. Particularly, controller 56 can receive one or more inputs from fire detection device 126 indicating whether the detected fire is still active, i.e., whether the fire has been extinguished. By way of example, fire detection device 126 can be a temperature sensing device. In such an example, controller 56 can receive one or more inputs from fire detection device 126 indicative of the temperature within chamber 25 of drum 26. Controller 56 can determine whether the sensed temperature is less than a predetermined threshold (e.g., a predetermined temperature threshold).

When controller 56 determines that the sensed temperature is not less than the predetermined threshold, controller 56 continues controlling fire extinguishing system 100 to extinguish the detected fire. However, when controller 56 determines that the sensed temperature is less than the predetermined threshold, controller 56 ceases extinguishing operations. Particularly, controller 56 can cause water inlet valve 110 to move to the closed position to stop the flow of water from nozzle 140. Stated another way, controller 56 can cause water inlet valve 110 to prevent water from flowing to nozzle 140.

It will be appreciated that controller 56 can cease extinguishing operations based on other criteria. As one example, controller 56 can cease extinguishing operations after performing such operations for a predetermined time, e.g., five (5) minutes. As another example, fire detection device 126 can be a camera operable to capture one or more images (e.g., still image and/or video) of chamber 25 of drum 26. Based at least in part on the one or more captured images, controller 56 can determined whether the fire is extinguished in drum 26.

Although specific features of various embodiments may be shown in some drawings and not in others, this is for convenience only. In accordance with the principles of the present disclosure, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance, comprising:

a cabinet;

a drum rotatably mounted within the cabinet, the drum defining a chamber for receipt of articles for drying;

a nozzle defining an extinguisher outlet;

a breakaway cap mounted to the nozzle, the breakaway cap defining a steam outlet, and wherein i) water flows through the extinguisher outlet and then downstream through the steam outlet of the breakaway cap and into the chamber of the drum when water provided to the nozzle does not apply a threshold force on the breakaway cap, and ii) the breakaway cap breaks away from the nozzle and water flows through the extinguisher outlet into the chamber of the drum when water provided to the nozzle applies the threshold force on the breakaway cap.

2. The dryer appliance of claim 1, wherein the extinguisher outlet has a first diameter and the steam outlet has a second diameter, and wherein the first diameter is greater than the second diameter.

3. The dryer appliance of claim 2, wherein the first diameter of the extinguisher outlet is at least ten times greater than the second diameter of the steam outlet.

4. The dryer appliance of claim 1, wherein the nozzle has a flange and the breakaway cap has a securing mechanism, and wherein when the breakaway cap is mounted to the nozzle, the securing mechanism of the breakaway cap is secured to the flange of the nozzle.

5. The dryer appliance of claim 4, wherein the flange is an annular flange.

6. The dryer appliance of claim 5, wherein the nozzle defines and axial direction and a radial direction, and wherein the annular flange extends outward from a body of the nozzle along the radial direction.

7. The dryer appliance of claim 4, wherein the securing mechanism is a securing flange.

8. The dryer appliance of claim 1, further comprising:

a fire detection device operable to detect a fire.

9. The dryer appliance of claim 8, wherein the fire detection device has a temperature sensing device operable to sense a temperature of air within the chamber of the drum.

10. The dryer appliance of claim 8, further comprising:

a water inlet valve in fluid communication with a water supply and the nozzle;

a controller communicatively coupled with the fire detection device and the water inlet valve, the controller being configured to:

receive, from the fire detection device, an input indicating detection of the fire; and in response to the received input, cause the water inlet valve to allow water to flow from the water supply to the nozzle such that water provided to the nozzle applies the threshold force on the breakaway cap causing the breakaway cap to break away from the nozzle and so that water flows through the extinguisher outlet and into the chamber of the drum.

11. The dryer appliance of claim 10, wherein prior to causing the water inlet valve to allow water to flow from the water supply to the nozzle in response to the received input, the controller is further configured to:

cause the water inlet valve to hold a volume of water upstream thereof for a predetermined time to increase a water pressure of the volume of water such that when the controller causes the water inlet valve to allow water to flow from the water supply to the nozzle, a burst of water is provided to the nozzle to apply the threshold force on the breakaway cap.

12. The dryer appliance of claim 10, wherein the controller is further configured to:

receive, from the fire detection device, a second input indicating whether the fire has been extinguished; and in response to the received second input, cause the water inlet valve to move to a closed position such that water is prevented from flowing downstream to the nozzle.

13. The dryer appliance of claim 1, further comprising:

a water inlet valve in fluid communication with a water supply and the nozzle;

a controller communicatively the water inlet valve, the controller being configured to:

receive an input indicative of instructions for commencing a steam operation; and in response to the received input, cause the water inlet valve to allow water to flow from the water supply to the nozzle such that water provided to the nozzle does not apply the threshold force on the breakaway cap and so that water flows through the extinguisher outlet and then downstream through the steam outlet of the breakaway cap and into the chamber of the drum such that water mixes with air within the chamber to form steam.

14. The dryer appliance of claim 1, further comprising:

a rear drum support positioned at a rear portion of the drum and enclosing the chamber, the rear drum support defining one or more openings, and wherein the nozzle extends through one of the one or more openings.

15. The dryer appliance of claim 1, wherein the drum extends between a front portion and a rear portion along a transverse direction, and wherein the drum defines a transverse centerline midway between the front portion and the rear portion of the drum, and wherein when the breakaway cap breaks away from the nozzle and water flows through the extinguisher outlet into the chamber of the drum, the nozzle directs a stream of water into the chamber such that the ejected water reaches at least the transverse centerline of the drum.

16. A dryer appliance, comprising:

a cabinet;

a drum rotatably mounted within the cabinet, the drum defining a chamber for receipt of articles for drying;

a nozzle in fluid communication with the chamber of the drum, the nozzle defining an extinguisher outlet;

a breakaway cap mounted to the nozzle and defining a steam outlet through which water is ejected into the chamber of the drum to form steam;

a water inlet valve in fluid communication with a water supply and the nozzle;

a fire detection device operable to detect fires; and a controller communicatively coupled with the fire detection device and the water inlet valve, the controller configured to:

receive, from the fire detection device, an input indicating that a fire is present in the dryer appliance; and in response to the received input, cause the water inlet valve to allow water from the water supply to flow downstream to the nozzle so that the breakaway cap breaks away from the nozzle and water flows through the extinguisher outlet into the chamber of the drum.

17. The dryer appliance of claim 16, wherein the water inlet valve has an outlet, and wherein the dryer appliance further comprises:

a delivery conduit fluidly connecting the outlet of the water inlet valve with the nozzle.

18. The dryer appliance of claim 16, further comprising:

a rear drum support positioned at a rear portion of the drum and enclosing the chamber, the rear drum support defining one or more openings, and wherein the nozzle extends through one of the one or more openings.

19. The dryer appliance of claim 16, wherein the controller is further configured to:

receive, from the fire detection device, a second input indicating whether the fire has been extinguished; and when the second input indicates that the fire has been extinguished, cause the water inlet valve to prevent water from flowing to the nozzle.

* * * * *